US005133238A

United States Patent [19]

Ostendorf

[11] Patent Number: 5,133,238

[45] Date of Patent: Jul. 28, 1992

[54] MUSICAL WIND INSTRUMENT

[76] Inventor: Philip J. Ostendorf, 1047 Mariner Dr., Key Biscayne, Fla. 33149

[21] Appl. No.: 561,524

[22] Filed: Aug. 2, 1990

[51] Int. Cl.[5] ..... G10D 7/10

[52] U.S. Cl. ..... 84/387 R

[58] Field of Search ..... 84/387 R, 387 A, 388–401; D17/10, 11, 12, 13

[56] References Cited

U.S. PATENT DOCUMENTS

| | | | |
|---|---|---|---|
| 903,059 | 11/1908 | Conn | 84/387 R X |
| 962,574 | 6/1910 | Kaufman | 181/188 |
| 982,732 | 1/1911 | Lehnert | 84/387 R X |
| 1,301,147 | 4/1919 | Magin | 84/400 |
| 1,338,108 | 4/1920 | Sordillo | 84/400 |
| 1,342,846 | 6/1920 | Santa Emma | 84/400 |
| 1,445,115 | 2/1923 | Turner | 84/400 |
| 2,059,898 | 11/1936 | Osborne | 84/395 X |
| 2,244,205 | 6/1941 | Koeder | 84/400 |
| 2,470,597 | 5/1949 | Woodward | 84/400 |
| 3,529,505 | 9/1970 | Brooks | 84/387 R |
| 4,273,021 | 6/1981 | Mackie | 84/400 |
| 4,273,022 | 6/1981 | Bell | 84/400 |
| 4,516,464 | 5/1985 | Hastings | 84/387 R |
| 4,885,971 | 12/1989 | Ostendorf | 84/396 |

FOREIGN PATENT DOCUMENTS

| | | |
|---|---|---|
| 47280 | 6/1909 | Switzerland . |
| 2766 | 12/1958 | United Kingdom . |

OTHER PUBLICATIONS

Montague, "The World of Romantic and Modern Musical Instruments", The Overlook Press, Woodstock, N.Y. 1981, pp. 76–81 and 92–94, Title and Copyright Page.

See discussion in accompanying Response etc. Relating to Ref. AS.

*Primary Examiner*—L. T. Hix

*Assistant Examiner*—Howard B. Blankenship

*Attorney, Agent, or Firm*—Roger S. Dybvig

[57] ABSTRACT

A musical instrument which may be used to play a complete major scale without coordinated mouth and finger operations has a single mouthpiece, an outer tubing assembly or horn connected to the mouthpiece and terminating in a bell, and an inner tubing assembly or horn mounted concentrically within the outer horn. The inner horn has an open, upstream end located inside the outer horn and either an open or a closed downstream end projecting outwardly from the belled end of the outer horn. If open, the downstream end of the inner horn is either belled or tubular. The inner horn preferably is in the form of a straight tube which is closed at its outer end by a cap but may be opened or belled.

15 Claims, 2 Drawing Sheets

MUSICAL WIND INSTRUMENT

BACKGROUND OF THE INVENTION

This invention relates broadly to wind operated musical instruments and particularly to those musical instruments which are resonant in response to vibrating air columns induced therein to produce tones of various different pitches.

Conventional wind instruments may be categorized in accordance with the manner in which a vibrating air column is induced in them. Thus, there are lip reed instruments, examples of which include trumpets, coronets, trombones, french horns, and bass horns; reed instruments, examples of which include clarinets, saxophones, oboes, and bassoons; and split-air-stream instruments, examples of which include piccolos and flutes.

In each of the above-mentioned instruments, as well as in many other instruments, sound vibrations are created at an inlet or mouthpiece and these sound vibrations are channeled through an elongated instrument tube whose effective length is configured, that is lengthened or shortened, to create resonance therein so as to amplify the sound vibrations and promulgate them to the surrounding area. The original sound vibrations at the mouthpiece are created in different ways for different instruments. For the lip reed instruments, the vibrations are created by vibrating lips whereas for the reed instruments the vibrations are caused by single or double reeds. For the split-air-stream instruments, air is caused to vibrate by passing over air-splitting baffle edges. In each of these instruments, a musician can control these initial vibrations with mouth activity by controlling the quantity, velocity and/or direction of air flow, by the position of the lips, etc. By using mouth control, a musician can control to a great extent musical sounds which exit from a musical wind instrument, and in this regard, some instruments, such as a bugle, are played totally by mouth control. However, mouth control related to a single effective air column length is somewhat limited and does not allow a full range of musical notes.

The frequencies of the vibrations at which an instrument is resonant depend upon the length of the instrument, that is, the length of the tube between its air inlet and its air outlet. This length determines, but is not quite equal to, the effective length of the air column in which the sound waves are formed that, at certain frequencies, cause the instrument to resonate and thereby amplify the sound output of the instrument. It is well known that, to resonate at any given frequency, an instrument must have an effective air column equal in length to an integer multiple of one-half of the wave length of that frequency. This forms the basis for the so-called "harmonic series" of notes that can be resonant and amplified by an instrument having an air column of a given effective length, which series may be expressed by the series of fractions 1/2, 2/2, 3/2, 4/2 . . . n/2, wherein the numerator represents the number of one-half waves formed in the air column.

The common bugle has a single fixed length and is therefore capable of resonating only at frequencies within a single harmonic series. It cannot be used to produce a complete major or minor scale. In order to extend the range of the several instruments mentioned above, so that they may be used to produce not only major and minor scales but also complete chromatic scales, the instruments are provided with mechanisms to change the tube and effective air column lengths. Such mechanisms usually comprise telescoping slides, openable ports, or depressible or rotatable valve keys to provide openings to differing combinations of tubing sections. Because of the ability to change the effective air column lengths, the instruments can be used to produce multiple sets of harmonic series and thereby to produce complete chromatic scales.

The frequency, and therefore the pitch, of vibration of a wind instrument depends upon the frequency of the input to the instrument. Typically, a wind instrument, including its mouthpiece, is so constructed that one may produce frequencies beginning with the first or second harmonic number and, depending upon the skill of the musician, extending upwardly through several harmonic numbers. One may change the inlet openings so that the frequencies produced tend to be in the higher harmonic ranges. For example, an instrument made by equipping a bass horn with a conventional trumpet mouthpiece may not be usable to play the lower harmonics but could be used for playing higher harmonics than can be obtained using a conventional bass horn mouthpiece. This is because the bass horn mouthpiece is designed to enable one to vibrate the lips at lower frequencies than possible with a trumpet mouthpiece, at the expense of higher frequencies available using a trumpet mouthpiece.

As those skilled in the art are aware, the number of scale notes between the members of a harmonic series decreases as the harmonic number increases. This phenomena is demonstrated by the following Table I, which is for a trombone having an effective air column length of 9.43 feet. (This Table I and Table II and Table III below are calculated using an assumed speed of sound of 1100 feet per second—which is not quite accurate but is sufficient for purposes of understanding this invention.)

TABLE I

| Harmonic | Pitch | Wave Length | Scale | Air Col. | Frequen. |
|---|---|---|---|---|---|
| 2/2 | A# | 9.43' | 116.54 cps | 9.43' | 116.54 |
| | B | | 123.41 | | |
| | c | | 130.81 | | |
| | C# | | 137.59 | | |
| | D | | 146.83 | | |
| | D# | | 155.56 | | |
| | E | | 164.81 | | |
| 3/2 | F | 6.29 | 174.61 | 9.43 | 174.81 |
| | F# | | 185.00 | | |
| | G | | 196.00 | | |
| | G# | | 207.65 | | |
| | A | | 220.00 | | |
| 4/2 | A# | 4.72 | 233.08 | 9.43 | 233.08 |
| | B | | 246.94 | | |
| | C | | 261.63 | | |
| | C# | | 277.18 | | |
| 5/2 | D | 3.78 | 293.66 | 9.43 | 291.35 |
| | D# | | 311.13 | | |
| | E | | 329.63 | | |
| 6/2 | F | 3.15 | 349.23 | 9.43 | 349.62 |
| etc. | | | | | |

One may observe from Table I that a trombone with an effective air column of 9.43 feet is capable of playing notes of ascending pitch in the sequence A#, F, A#, D, and F. Of course, a trombone usually has a slide for increasing the length of its effective air column so that other harmonic series can be formed. One may also observe from Table I that there are six half-tone notes between harmonic 2/2 and 3/2, four half-tone notes between harmonic 3/2 and 4/2, three half-tone notes between harmonic 4/2 and 5/2, and only two half-tone notes between 5/2 and 6/2. If the harmonic number is raised high enough, an instrument will play adjacent half tone notes. (At even higher harmonics, an instrument would play quarter tones.)

A problem with musical wind instruments capable of playing complete scales is that they require considerable skill, patience, and practice to play. Not only must musicians be dexterous with their fingers to reconfigure the instrument tubes, they must also memorize all of the proper positions and coordinate them with their lip movements.

An object of this invention to provide a musical wind instrument which may be used to play more notes than possible with a conventional instrument having a fixed tube length but which is simpler to play than conventional wind intruments having mechanisms for changing their tube lengths. More particularly, it is an object of this invention to provide a musical wind instrument which may be used to play a complete major scale without coordinated mouth and finger operations.

Another object of this invention is to provide a musical wind instrument which may be used to produce a complete chromatic scale with a minimum of coordinated mouth and finger operations.

Another object of this invention is to provide such a musical wind instrument which has a reasonably acceptable tone quality.

Broadly speaking, the objects of this invention are the same as objects of the invention described in my U.S. Pat. No. 4,885,971, granted Dec. 12, 1989, and, in addition, to achieve results superior to the results obtainable with apparatus constructed in accordance with the teachings of that patent. U.S. Pat. No. 4,885,971 discloses a musical wind instrument comprising a single mouthpiece, an energy divider extending from the mouthpiece that divides the sound energy entering the mouthpiece into two or three streams, a tubing assembly for each of the streams connected to outlets from the energy divider, the tubing assemblies having open distal or free ends, one or all of which may terminate in a bell. A tubing assembly could also terminate in a straight, open-ended tube instead of a bell. The different tubing assemblies are of respectively different lengths so that they resonate at different frequencies and thus may be used to produce more musical notes than possible with a single, fixed-length instrument. In effect, an instrument in accordance with the '971 patent may comprise two horns with a single inlet, with the length of one horn having a fundamental (harmonic 2/2) which is one half tone above the fundamental of the other horn. Other workable embodiments may have two horns having a difference in their respective fundamentals of two half tones. Still other embodiments may include a third horn having an inlet opening common with the other two horns, the third horn having a fundamental which is higher, again by one or two half tones, than the higher of the other two horns. The tubing assemblies may have ports which are used to produce scale tones that are otherwise not obtainable with the unported tubing. Major key scales can be played on such a horn without requiring hand control. Full chromatic scales of consecutive tones can be obtained with the use of ports.

Although instruments made in accordance with the teachings of the '971 patent are usable, there are disadvantages in that the lip buzz energy input that is traveling through the non-resonating branch or branches ends as an air rush sound so that one-half or less of the input is used to cause resonance in the resonating tube assembly. Also, musically inferior tones are occasionally caused by an averaging of pitches produced at the same time in more than one branch. A further object of the instant invention is to avoid or minimize the drawbacks of the '971 instruments.

In accordance with this invention, a musical instrument comprises a single mouthpiece, a hollow, outer tubing assembly or horn connected to the mouthpiece and terminating in a bell, and a hollow inner tubing assembly or horn mounted concentrically within the outer tubing assembly at its belled end. The inner horn has an open, upstream end located inside the outer horn and either an open or a closed downstream end projecting outwardly from the belled end of the outer horn. If open, the downstream end of the inner horn could be belled or tubular. In the presently preferred embodiment, the inner horn is in the form of a straight tube which is closed at its outer end by a cap.

Tests have shown that the presence of the inner horn can produce two beneficial results: additional scale tones can be produced without the use of valves or slides and the frequency of certain off key tones produced by the outer horn alone can be corrected to be "on key". The correction of the pitch can result from an averaging of tones produced by the combined horns and from the lowering of a pitch produced by the outer horn because the air column of the outer horn is partly obstructed by the inner horn.

In a preferred practice of this invention, a mouthpiece is used which enables the two horns to be played without substantial difficulty in a range of frequencies beginning at the 4/2 harmonic and extending through the 16/2 harmonic. A musician with a well-trained lip may extend the range through the 20/2 harmonic. Such an instrument with an outer horn and one inner horn can play a complete major scale and several additional scale tones.

Further in accordance with embodiments of this invention, the outer horn may be provided with one or two normally closed (by keys or the musician's fingers) ports adjacent its distal or free end, namely an "accidental" port for sharps and flats, and a "scale" or range-extending port, both ports being near the belled end thereof. The port or ports, if used, are spaced to provide a musical interval of half tones of higher pitch with respect to the originating horn pitch. They may be made adjustable to permit slight changes in tuning to accommodate other instruments of fixed pitch when playing in concert.

The inner horn may have a telescoping slide for adjusting its length to adjust the family of pitches that it causes to depress. The inner horn may also be adjustable to different lengths relative to the distal end of the outer horn to adjust the pitch of the instrument.

In another aspect of this invention an attachment may be provided that adds an inner horn to an existing horn to convert the existing horn to an instrument capable of playing a major scale without the use of valves or slides.

Other objects and advantages will become apparent from the following description and the drawings.

DETAILED DESCRIPTION

Figure 1:
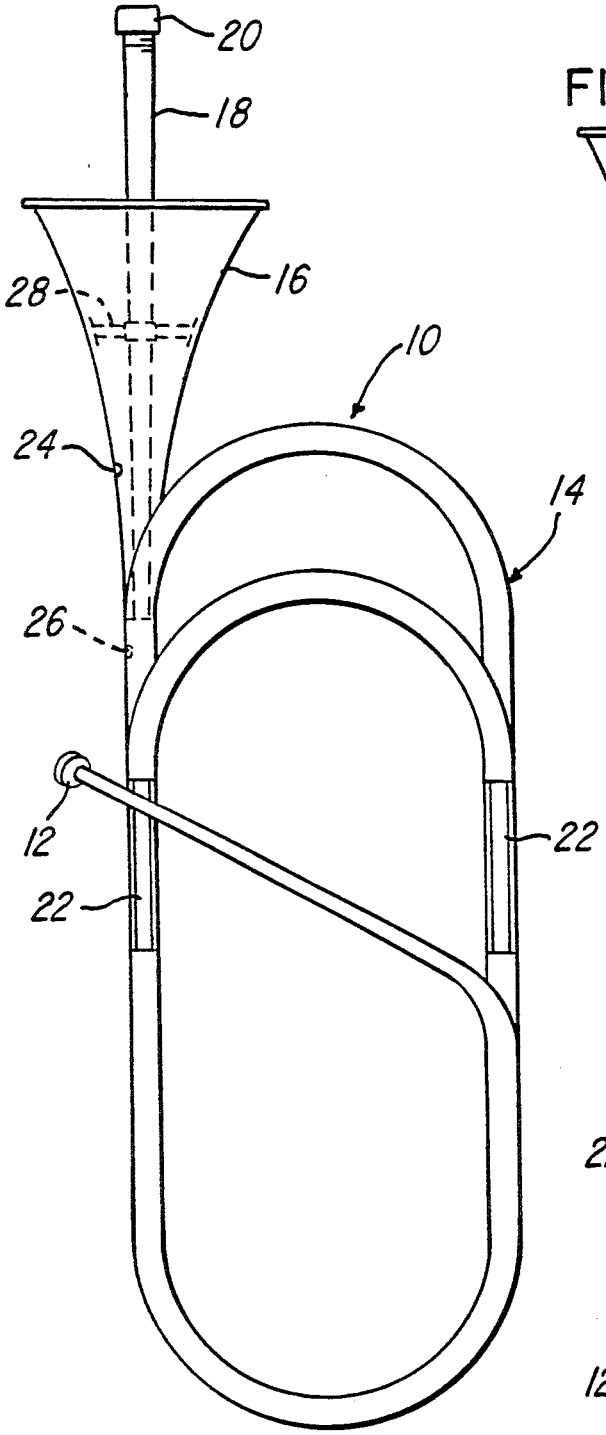
FIG. 1 is an elevational view of a musical wind instrument in accordance with the presently preferred embodiment of this invention.
Figure 2:
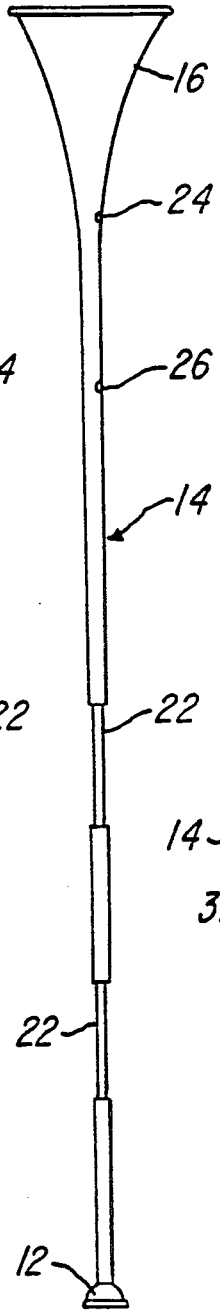
FIG. 2 is a diagrammatic view of the outer horn of the instrument of FIG. 1 shown as if unbent from the shape shown in FIG. 1.
Figure 3:
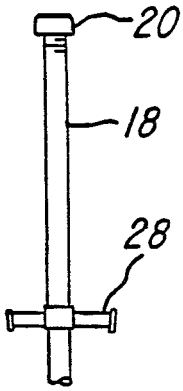
FIG. 3 is a diagrammatic view of the inner horn of the instrument of FIG. 1.

A first, and presently preferred, embodiment of a musical wind instrument 10 in accordance with this invention is shown in FIGS. 1, 2, and 3 to comprise a single inlet in the form of a cup-shaped mouthpiece 12, a first, hollow outer tubing assembly or horn 14 having a proximal end connected and opening to the distal end of the mouthpiece 12 and a distal end terminating in a bell 16, and further comprising a second, hollow inner tubing assembly or horn 18 mounted at the distal end of the inner horn 14 and having a proximal end opening inside the inner horn 14 and a distal end projecting outwardly of the bell 16. The extreme distal end of the inner horn 18 is closed by a threaded cap 20 or the like. The outer horn 14 may be provided with conventional tuning slides 22, an "accidental" port 24 for sharps and flats, and a "scale" or range-extending port 26, both ports being near the belled end 16 of the outer horn 14. As will be described below, only one, or neither one, of the ports 24 and 26 need be provided. The horn tubes may be cylindrical or conical or partly each. The taper or lack of taper are merely determining factors for the timbre of the horn.

The inner horn 18 is held concentrically within the outer horn 14 by a spider 28 which may be affixed, as by brazing, to the confronting surfaces of both horns.

Although various different combinations of horn lengths and port placements could be used, both theory and experiment indicate the following criteria are optimal for an instrument 10 capable of playing a complete chromatic scale.

1. An outer horn 14 having an effective air column length equal to the sound velocity in the ambient air conditions divided by the fundamental (2/2) frequency of the horn.
2. An accidental port 24 having an effective air column length equal to the sound velocity in the ambient air conditions divided by the fundamental (2/2) frequency of the next higher scale one-half tone above the external horn fundamental (2/2) frequency.
3. A scale port 26 having an effective air column length equal to the sound velocity in the ambient air conditions divided by the fundamental (2/2) frequency of the next higher scale whole tone above the external horn fundamental (2/2) frequency.
4. An inner horn 18 having an effective air column length equal to the sound velocity in the ambient air conditions divided by four times the fundamental (2/2) frequency of the third note "mi" of the external horn scale with "do" as the 6/2 harmonic. Another way of stating the effective air column length is ¼ of the "mi" wave length.
5. An inner horn 18 having a capped end positioned at a distance equal to 15 times the air column length of the internal horn or, stated in another way, 7.5 divided by 2, i.e. 3.75, t1mes the "mi" wave length.

Those familiar with the art will understand that the effective air column lengths stated above are approximations. The precise lengths will depend upon the temperament or intonation desired by the manufacturer. The distance from the mouthpiece to the capped end of the inner horn 18 seems to be quite critical (with less than ⅛ inch tolerance), and it is presently believed that best results may be obtained when the effective air column length of the outer horn matches the effective air column length of a horn having a length of the outer horn plus the added length of that part of the inner horn 18 which projects beyond the outer horn 14.

Figure 5:
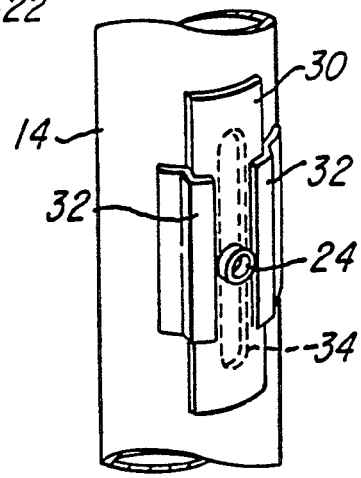
FIG. 5 is a fragmentary perspective view illustrating an adjustable port with which an instrument of this invention may be provided.

Although the foregoing criteria seem technically preferred, the function of the scale port 26, which is to lower the harmonic range of the intrument 10, may for the sake of simplicity be omitted. Accidental port 24 is necessary for the instrument 10 to be capable of playing a complete chromatic scale and can be omitted if only a major scale capability is desired. To achieve precisely the desired air column lengths under various different atmospheric conditions would require that tuning adjustments be provided for both the outer horn and the inner horn. Thus, in addition to the tuning slides 22, which enable tuning of the outer horn 14, the inner horn is also provided with a conventional tuning slide (not shown). The depth to which the inner horn 18 is inserted into the outer horn 14 may also be adjustable in order to control the degree by which the frequencies of some notes are depressed. As shown in FIG. 5, the port 24 may be located in a manually slidable plate 30 frictionally retained and guided by gibs 32. As is apparent, the ported plate 30 is slidable over a portion of the tubing 14 which is provided with an elongated slot 34. As will be readily understood, the adjusted position of the port 24 will determine the effective length of the air column created when the port 24 is opened while the instrument 10 is being played. Of course, the port 26 could be made adjustable in the same manner. Notwithstanding the foregoing discussion concerning tuning adjustments, full tuning capability may not always be desired, especially because of the importance of the relative positions of the two horns 14 and 18.

A comparison of Tables I (above), II, and III (below) will reveal the advantages of this invention. As previously noted, Table I sets forth the available frequencies over a range of operation of a trombone. It may be noted that several scale tones are available with an effective air column length of 9.43 feet. Table II sets forth available frequencies using a instrument 10 in accordance with this invention having an outer horn with an effective air column length of 18.88 feet and a capped inner horn 18 having an effective air column length of 1.25 feet and projecting beyond the outer horn 14 by 3.39 inches. Such an instrument may have an outer horn 14 having an actual length of 17.98 feet, an inner horn 18 which is 1.22 feet, and a capped end located 18.31 feet from the mouthpiece. Some pitches of the instrument 10 appear to be caused solely by the outer horn 14 and some solely by the inner horn 18. In addition some tones appear to result from an averaging of tones produced by both horns, and some appear to be tones produced by the outer horn 14 but lowered in pitch due to the velocity-increasing effect of the inner horn 18 (akin to the lowering of certain tones of French horns by the practice of inserting a hand into the bell of the horn.) It may be noted that the instrument on which Table II is based is capable of playing a major scale. Table III sets forth the pitches available using the same horn on which Table II is based, but with the use of an accidental port 24. In this case, a complete chromatic scale is available.

TABLE II

| Note | Scale Frequency | | Outer Horn Frequency | | Inner Horn Frequency | | Inner Horn Insertion | |
|---|---|---|---|---|---|---|---|---|
| Dc | 174.61 | F | 174.81 | 6/2 | | | | |
| | 184.99 | | | | | | | |
| Re | 195.99 | G | | | | | 195.99 | Dep |
| | 207.64 | | 203.95 | 7/2 | | | | |
| Mi | 220.00 | A | | | 220.00 | 2/2 | | |
| Fa | 233.08 | A# | 233.08 | 8/2 | | | | |
| | 246.94 | | | | | | | |
| So | 261.62 | C | 252.22 | 9/2 | | | | |
| | 277.18 | | | | | | | |
| La | 293.66 | D | 291.35 | 10/2 | | | | |
| | 311.12 | | | | | | | |
| Ti | 329.62 | E | 320.49 | 11/2 | 330.00 | 3/2 | | |
| Do | 349.21 | F | 349.62 | 12/2 | | | | |
| | 369.99 | | 378.76 | 13/2 | | | | |
| Re | 391.99 | G | 407.89 | 14/2 | | | 391.99 | Dep |
| | 415.29 | | 437.03 | 14.2 | | | | |
| Mi | 440.00 | A | 466.16 | 15/2 | 440.00 | 4/2 | | |
| Fa | 466.15 | A# | 495.30 | 16/2 | | | | |
| | 493.87 | | 524.43 | 17/2 | | | | |
| So | 523.24 | C | 553.57 | 18/2 | 550.00 | 5/2 | | |
| | 554.37 | | 582.70 | 19/2 | | | | |
| La | 587.33 | D | 611.84 | 20/2 | | | | |

TABLE III

| Note | | Scale Frequency | Port Frequency | | Outer Horn Frequency | | Inner Horn Frequency | |
|---|---|---|---|---|---|---|---|---|
| Do | F | 174.61 | | | 174.81 | 6/2 | | |
| | F# | 184.99 | 6/2 | 185.21 | | | | |
| Re | G | 195.99 | | | 195.99 | | 195.99 | Dep. |
| | G# | 207.65 | 7/2 | 216.07 | | 7/2 | | |
| Mi | A | 220.00 | | | 220.00 | | 220.00 | 2/2 |
| Fa | A# | 233.08 | | | 233.08 | 8/2 | | |
| | B | 246.94 | 8/2 | 246.94 | | | | |
| So | C | 261.62 | | | 262.22 | 9/2 | | |
| | C# | 277,18 | 9/2 | 277.81 | | | | |
| La | D | 293.66 | | | 291.35 | 10/2 | | |
| | D# | 311.12 | 10/2 | 308.68 | | | | |
| Ti | E | 329.62 | | | 325.24 | 11/2 | 330.00 | 3/2 |
| Do | | 349.22 | 11/2 | 339.54 | 349.62 | 12/2 | | |
| | F# | 370.00 | 12/2 | 370.41 | | | | |
| Re | G | 391.99 | 13/2 | 401.28 | 383.56 | 13/2 | 391.98 | Dep. |
| | G# | 415.29 | 14/2 | 432.15 | | 14/2 | | |
| Mi | A | 440.00 | | | 440.00 | 15/2 | 440.00 | 4/2 |
| Fa | A# | 466.15 | 15/2 | 463.01 | 468.87 | 16/2 | | |
| | B | 493.87 | 16/2 | 493.88 | | 17/2 | | |
| So | C | 523.25 | 17/2 | 524.75 | 525.74 | 18/2 | | |
| | C# | 554.36 | 18/2 | 555.62 | 553.57 | 19/2 | 550.00 | 5/2 |
| La | D | 587.54 | 19/2 | 586.49 | 582.42 | 20/2 | | |

Thus, it is seen that the instrument 10 is so constructed that the inner horn 18 has a fundamental pitch that adds notes that would be missing from a single horn having the same length as the outer horn 14. Further, the instrument 10 has an extended range down to the 6/2 harmonic. Some of the inaccurate pitches (of a single horn) are improved by averaging and some are modified by depression. This extends the range from one to nearly two octaves.

Figure 4:
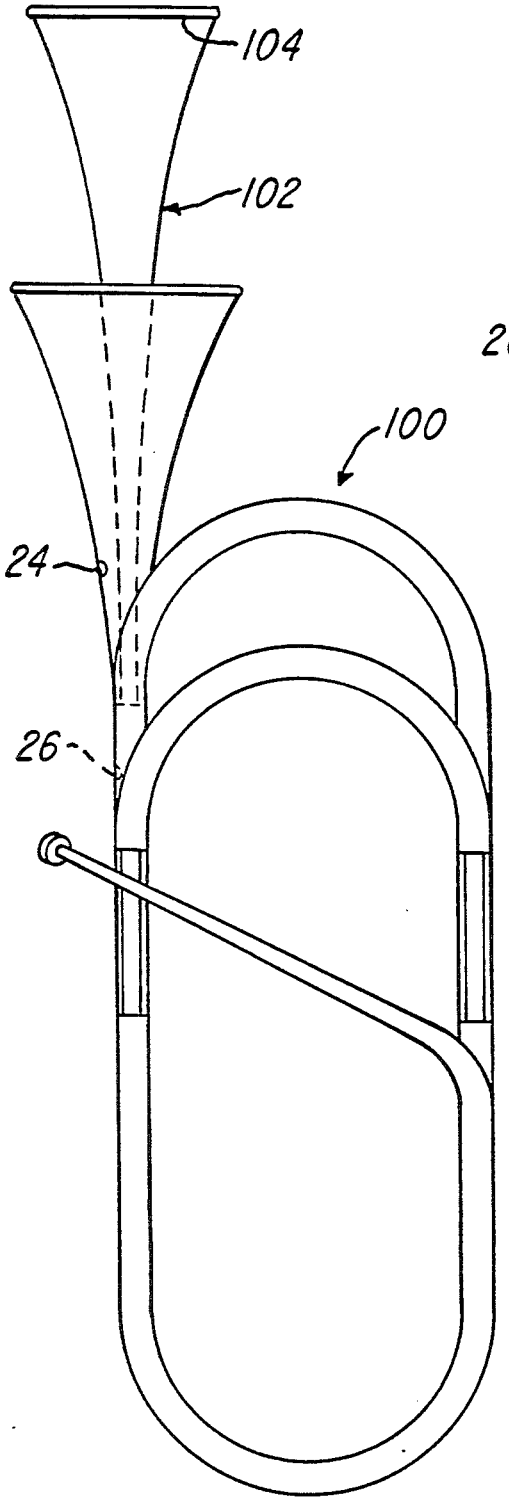
FIG. 4 is an elevational view of a musical wind instrument in accordance with a second embodiment of this invention.

FIG. 4 shows a second embodiment of a musical instrument, generally designated 100, in accordance with this invention. This has the same construction as the first embodiment, except that the inner horn, designated 102, is in the form of cylindrical tubing that terminates at its outer end in a bell, designated 104. The instrument 100 can also be used to provide a good major scale and, with an openable port, will provide a good chromatic scale. However, experimental results indicate that the inner horn has to be quite long in order to produce results comparable to the capped tube version of FIG. 1. The excessive length could be partly mitigated in part by coiling part of the inner horn 100 about its longitudinal axis.

As another option, which is not illustrated herein, the cap 22 may be omitted from the inner horn, in which case the inner horn will have to be significantly longer than the capped inner horn, but not as long as a belled and open inner horn. Other modifications are, of course, possible. Some trial and error may be required in each case to obtain optimum results.

This invention could be extended to an instrument (not shown) having a second, concentric inner horn. Such an instrument may successfully add additional scale notes, but is presently believed impractical because of numerous off key notes that would be produced.

Figure 6:
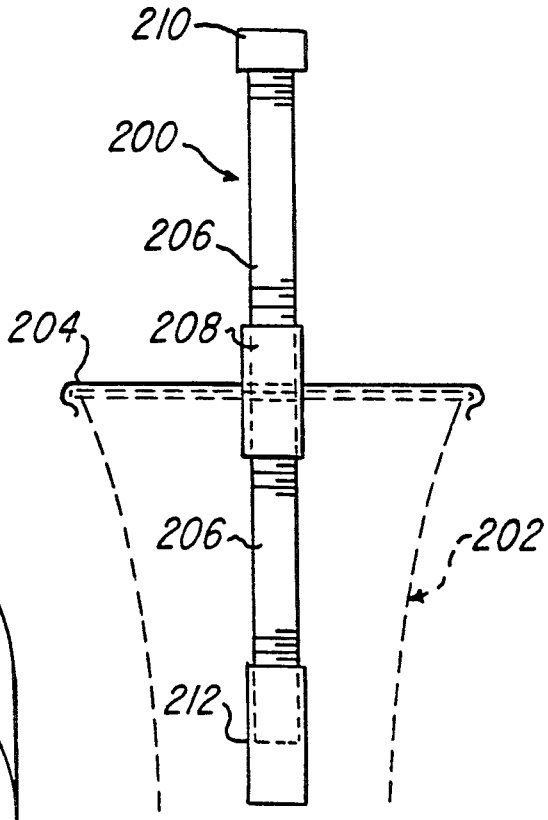
FIG. 6 is a diagrammatic, elevational view of an attachment made in accordance with this invention for an existing musical instrument and showing, by phantom lines, a fragment of such a musical instrument.
Figure 7:
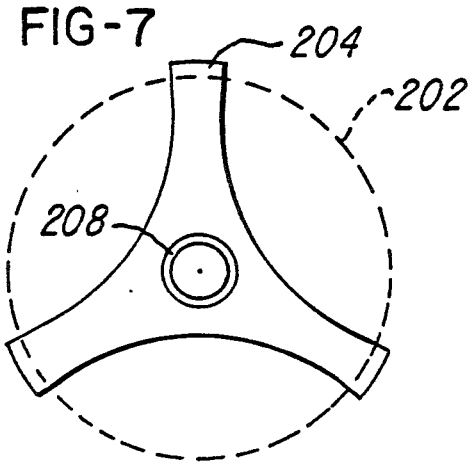
FIG. 7 is a plan view of a portion of the attachment of FIG. 6.

With reference to FIGS. 6 and 7, an attachment, generally designated 200, to an existing horn shown by phantom lines 202, such as a trombone, in accordance with an aspect of this invention, comprises a spider-like support member 204 clipped to the end of the horn 202. A straight tube 206, which could be made from two tubing sections, is threadedly or else slidably mounted in a tube coupling 208 affixed to the center of the spider 204 so as to be coaxial with the bell of the horn 202. Tubing 206 is preferably closed by cap 210 at its upper end. A threadedly or slidably adjustable extension sleeve 212 may be threadedly connected to the lower end of the tubing 208 to adjust the degree by which cetain notes are lowered. Played with a trumpet mouthpiece, in order to render it easy to play the higher harmonics, an instrument 202 provided with the attachment 200 may have characteristics similar to the instrument 10 of FIG. 1.

Although the presently preferred embodiment of this invention has been described, it will be understood that within the purview of this invention various changes may be made within the scope of the following claims.

Having thus described my invention, I claim:

1. A musical instrument which may be used to play a complete major scale without coordinated mouth and finger operations comprising a single mouthpiece and an outer horn connected to the mouthpiece and terminating in a bell, said mouthpiece and aid outer horn being so related that they can be used without substantial difficulty to produce notes in the range of the 4/2 through the 16/2 harmonics and thereby used without modification of the effective length of the outer horn to produce a substantial number of notes of said major scale, and said musical instrument further comprising an inner horn assembly mounted within said outer horn at its belled end, said inner horn assembly comprising at least one inner horn having an open, upstream end located inside said outer horn and having such length and diameter that notes of said scale can be produced by said musical instrument that cannot be produced by said mouthpiece and said outer horn alone.

2. The musical instrument of claim 1 wherein said inner horn is a straight tube.

3. The musical instrument of claim 2 wherein said inner horn has a closed distal end.

4. An attachment for a musical horn having a belled end for converting said horn to a musical instrument which may be used to play a complete major scale without coordinated mouth and finger operations, said attachment comprising a support member adapted to be connected to the belled end, and an inner horn assembly mounted on said support member, said inner horn assembly comprising at least one inner horn having an open, upstream end adapted to be located inside said musical horn, said inner horn having such length and diameter that notes of said scale can be produced by said musical instrument that cannot be produced by said musical horn alone.

5. The attachment of claim 4 wherein said inner horn is a straight tube.

6. The attachment of claim 4 wherein said inner horn has a closed distal end.

7. The attachment of claim 4 wherein said inner horn is adapted to be concentric with said musical horn.

8. The attachment of claim 4 wherein said inner horn assembly comprises plural inner horns.

9. The attachment of claim 4 wherein said inner horn assembly comprises two inner horns.

10. The attachment of claim 9 wherein both of said inner horns are adapted to be concentric with said musical horn.

11. The musical instrument of claim 1 wherein said inner horn is concentric with said outer horn.

12. The musical instrument of claim 1 wherein said inner horn assembly comprises plural inner horns.

13. The musical instrument of claim 1 wherein said inner horn assembly comprises two inner horns.

14. The musical instrument of claim 13 wherein both of said inner horns are concentric with said outer horn.

15. The musical instrument of claim 1 wherein said outer horn has an accidental port adjacent its belled end that may be opened to produce accidentals.

* * * * *